US005538033A

United States Patent [19]

Condon

[11] Patent Number: 5,538,033

[45] Date of Patent: Jul. 23, 1996

[54] COMPACT WASHING MACHINE OUTLET BOX WITH FORTY-FIVE DEGREE DRAIN

[76] Inventor: Duane R. Condon, 2230 Raymond Ave., Ramona, Calif. 92065

[21] Appl. No.: 456,948

[22] Filed: Jun. 1, 1995

[51] Int. Cl.[6] ..... A47B 77/06

[52] U.S. Cl. ..... 137/360; 312/229; 312/242

[58] Field of Search ..... 137/360, 229, 137/242

[56] References Cited

U.S. PATENT DOCUMENTS

| | | | |
|---|---|---|---|
| 1,108,283 | 8/1914 | Van Ness . | |
| 2,952,271 | 9/1960 | Dick et al. . | |
| 3,148,698 | 9/1964 | Arnold . | |
| 3,234,958 | 2/1966 | Butters . | |
| 3,495,276 | 2/1970 | Suess | 137/360 |
| 3,847,175 | 11/1974 | Anderson | 137/360 |
| 3,862,433 | 1/1975 | Rousselet | 137/360 |
| 4,069,837 | 1/1978 | Jirasek . | |
| 4,158,471 | 6/1979 | Logsdon . | |
| 4,410,004 | 10/1983 | Kifer et al. . | |
| 4,564,249 | 1/1986 | Logsdon . | |
| 4,716,925 | 1/1988 | Prather . | |
| 4,934,410 | 6/1990 | Humber . | |
| 5,305,785 | 4/1994 | Humber . | |
| 5,423,345 | 6/1995 | Condon . | |

*Primary Examiner*—A. Michael Chambers
*Attorney, Agent, or Firm*—Baker, Maxham, Jester & Meador

[57] ABSTRACT

A forwardly opening low profile washing machine outlet box configured so that it can be stamped as a unitary piece of sheet metal comprises a back wall having an upper vertical section and a lower downwardly extending forwardly sloping section, a forwardly extending peripheral wall integral with and extending forwardly from a peripheral edge of the back wall, first and second apertures in the upper wall section for mounting first and second valve shanks for receiving first and second water supply lines, and an enlarged aperture in said lower wall section for connecting to a drain line and for receiving a washing machine drain hose.

19 Claims, 5 Drawing Sheets

COMPACT WASHING MACHINE OUTLET BOX WITH FORTY-FIVE DEGREE DRAIN

BACKGROUND OF THE INVENTION

1. Field of the Invention

The present invention relates to plumbing installations, and more particularly, to boxes for use in attaching the water supply hoses and drain hose of a washing machine to corresponding boiler drain valves and a drain line mounted in a wall.

2. Description of the Related Art

Outwardly opening boxes have heretofore been mounted in a recessed fashion in a wall for providing a mounting fixture for a pair of boiler drain valves connected to hot and cold water supply lines in the wall. Such boxes have also typically been provided with a circular drain opening which is connected to a DWV drain pipe.

One common type of prior art washing machines outlet box typically includes a substantially rigid rectangular frame for being fixedly attached to two adjacent studs of the wall by way of ears and nails or the like. A first water valve is attached to the bottom of the frame adjacent one side wall thereof to allow a first water outlet and a first washing machine water hose to be attached thereto. A second valve is attached to the bottom of the frame adjacent the other side wall thereof to allow a second water outlet line and a second washing machine water hose to be attached thereto. A coupling member is attached to the bottom of the frame between the first and second water valves to allow a drain line and a washing machine drain hose to be attached thereto. The drain line includes a typical P-trap assembly. One problem with such prior art washing machine boxes is the requirement that one of the water outlet lines crosses over the P-trap assembly. Such cross overs are difficult and time consuming for the plumber and/or installer of the washing machine box, etc., and often prevent smooth installation of wall board or the like.

Another type of prior art washing machine outlet box also includes a substantially rigid rectangular frame for being fixedly attached to two adjacent studs of the wall by way of ears and nails or the like with a first water valve attached to the bottom of the frame adjacent one side thereof to allow a first water outlet line and a first washing machine hose to be attached thereto. However, the coupling member is attached to the bottom of the frame adjacent the other side wall and the second valve is attached to the bottom of the frame between the first water valve and the coupling member to allow a drain line and a washing machine drain hose to be attached to the frame adjacent one side wall thereof. One problem with such prior art washing machine boxes is the requirement that separate boxes be produced for installing the drain line and drain hose on the right or left of the water lines, etc.

In U.S. Pat. No. 4,716,925 of Prather there is disclosed a reversible side outlet washing machine box designed to overcome the problem mentioned in the previous paragraph. More specifically, the Prather patent discloses a washing machine outlet box having a reversible base member with means for allowing a first water valve to be connected to one end thereof, means for allowing a drain line to be attached to the other end thereof, and means for allowing a second water valve to be attached between the first water valve and the drain line.

U.S. Pat. No. 4,934,410 of Humber discloses a washing machine outlet box which allows hot and cold water boiler drain valves to be mounted in the center of the box regardless of whether the drain line if located to the left or to the right of the water supply lines.

U.S. Pat. Nos. 2,952,271 of Dick et al. and 4,410,004 of Kifer et al. disclose washing machine outlet boxes designed to accommodate electrical outlet boxes.

U.S. Pat. No. 4,069,837 of Jirasek discloses a washing machine outlet box incorporating a control unit connected to a pressure switch which senses a build-up of water pressure within the drain pipe to bring the electrical circuit to the washing machine.

Most washing machine outlet boxes which are currently in commercial production are made of injection molded plastic. There are many situations in which a washing machine outlet box needs to be installed in a fire wall, and in such cases, a metal washing machine outlet box must be utilized. Projects constructed for the U.S. Government typically require metal washing machine outlet boxes, including buildings constructed under the direction or supervision of the Department of Housing and Urban Development (HUD). Metal washing machine outlet boxes have heretofore been constructed of separate pieces of sheet metal which must be folded, assembled, soldered or welded, and then painted. Such metal washing machine outlet boxes have therefore been relatively expensive. It would therefore be desirable to provide a washing machine outlet box configuration which can be readily stamped from sheet metal to dramatically reduce the fabrication costs thereof. Preferably, the same washing machine outlet box configuration could also be injection molded from plastic for those installations not requiring a fireproof construction.

Washing machine outlet boxes heretofore commercially available have been relatively large. The wall in which a washing machine outlet box is typically installed is crowded with water supply lines, electrical lines, a drain line and a P-trap. In most washing machine outlet boxes, the boiler drain valves are mounted vertically. This makes it difficult to couple water supply lines which may extend downwardly in the wall from above the washing machine outlet box installation location. When the boiler drain valves are vertically oriented, it is often necessary for at least one of the water supply lines, when they extend horizontally, to cross over the drain pipe. This makes the installation more complex.

U.S. Pat. No. 4,564,249 of Logsdon discloses a so-called miniature washing machine outlet box which includes a drainpipe coupling with a tear-out disc which normally seals the opening for pressure testing. This washing machine outlet box still utilizes vertically oriented boiler drain valves and is intended for injection molded plastic construction. Therefore, it cannot be readily and inexpensively manufactured from metal. The embodiment of the Logsdon washing machine outlet box illustrated in FIGS. 7 and 8 of the Logsdon patent includes a single lever hot and cold water inlet valve. Brackets are attached to the side walls of the Logsdon washing machine outlet box to span the distance between adjacent wall studs and allow the washing machine outlet box to be nailed thereto.

SUMMARY OF THE INVENTION

It is therefore the primary object of the present invention to provide a compact, aesthetic washing machine outlet box which may be more easily connected to hot and cold water supply lines, washing machine supply hoses, and a drain line with a configuration that may be inexpensively stamped from sheet metal or injection molded of plastic.

Accordingly, the present invention provides a forwardly opening low profile washing machine outlet box configured so that it can be stamped as a unitary piece of sheet metal. The outlet box comprises a back wall having an upper vertical section and a lower downwardly extending forwardly sloping wall section, a forwardly extending peripheral wall integral with and extending forwardly from a peripheral edge of the back wall, first and second apertures in the upper vertical section for mounting first and second valve shanks for receiving first and second water supply lines, and an enlarged aperture in said lower wall section for connecting to a drain line and for receiving a washing machine drain hose.

BRIEF DESCRIPTION OF THE DRAWINGS

The above and other objects and advantages of the invention will become apparent from the following description when read in conjunction with the accompanying drawings wherein.

DESCRIPTION OF THE PREFERRED EMBODIMENT

Figure 1:
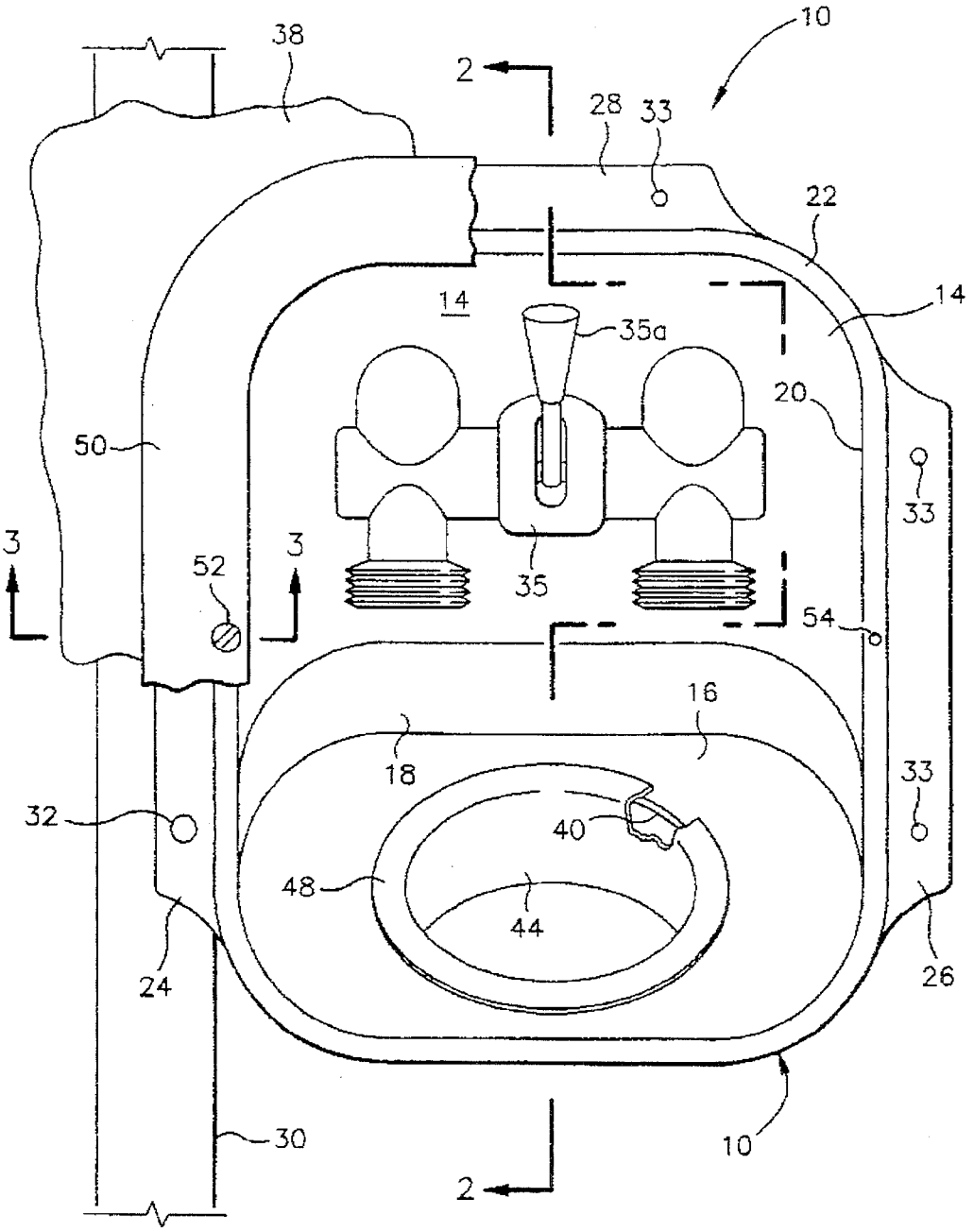
FIG. 1 is a is a front elevation view of a preferred embodiment of the invention mounted in a wall, with portions broken away to reveal details.

Referring to FIG. 1 of the drawings, a plumbing installation is illustrated including a forwardly opening low profile washing machine outlet box designated generally by the numeral 10 which mounts hot and cold water valves for connection and supply of hot and cold water to a washing machine and for accommodating an outlet drain. The box 10 is preferably constructed of sheet metal in a stamping or drawing process, although it may be molded of a suitable plastic as a single unitary piece. The stamping or drawing process is a well-known process using a progressive die and will not be described here in detail. The box 10 is thus preferably formed as a unitary sheet metal stamping. The corners may have a one inch radius.

Figure 3:
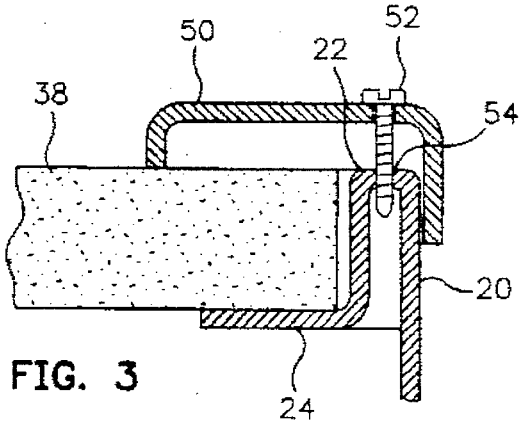
FIG. 3 is a horizontal sectional view taken along line 3—3 of FIG. 1.
Figure 2:
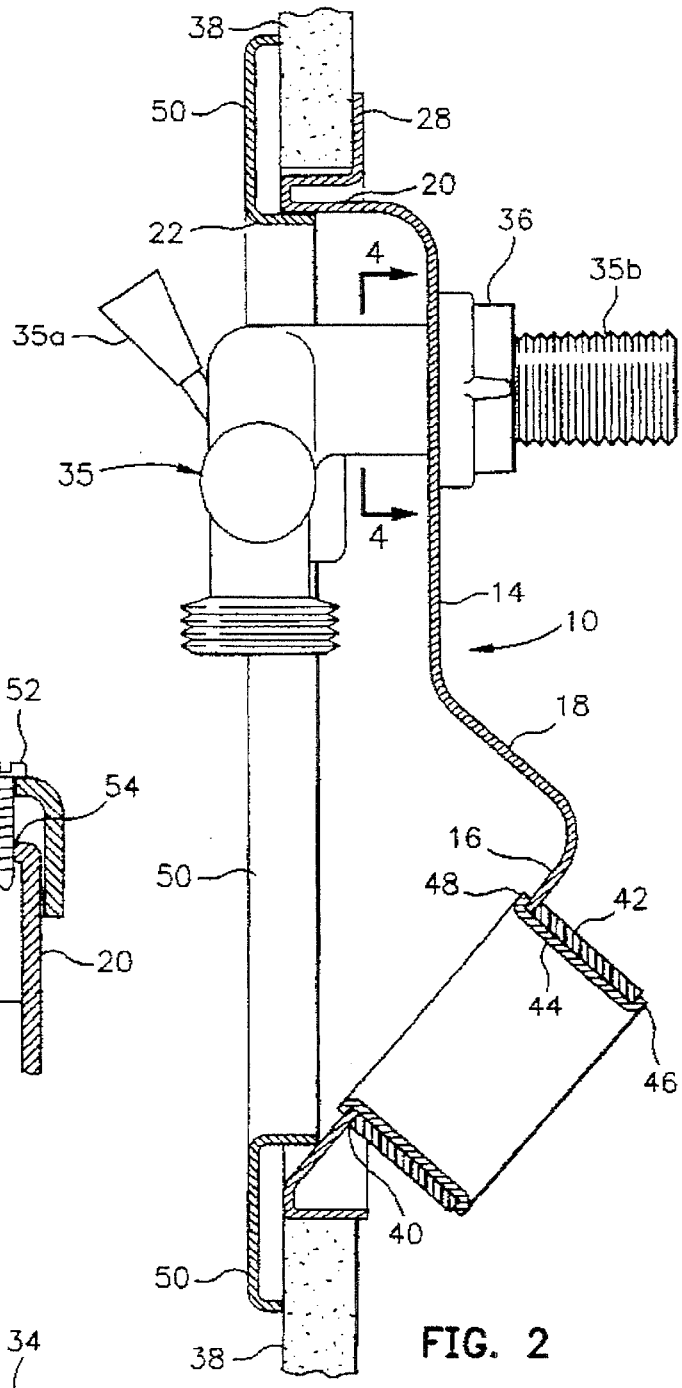
FIG. 2 is a vertical sectional view taken generally along line 2—2 of FIG. 1.

The box 10 is formed with an upper generally planar vertical back wall section 14 connected to a lower forwardly sloping generally planar bottom wall section 16 by an intermediate backwardly, downwardly sloping generally planar wall section 18. A forwardly extending peripheral wall 20 is integral with the upper and lower back wall sections 14 and 16 and extends forward with a somewhat rounded peripheral forward edge 22 forming the forwardmost portion thereof, as seen in FIGS. 2 and 3. The forward edge 22 is formed with side mounting flanges 24 and 26 and an upper mounting flange 28. These flanges provide a means for attachment of the box directly to building frame member such as a two-by-four stud 30 using nails 32 as shown. The nails are driven through holes such as 33 formed in the mounting flanges 24, 26 and 28. Alternatively, the upper mounting flange 28 may be secured by screws to a length of HYCO (Trademark) strap (not shown) nailed horizontally between adjacent studs.

The outlet box 10 preferably forms a recessed cavity having a width of approximately five inches and a height of approximately five and one-half inches. The upper back wall section 14 preferably forms about half of the entire back wall or up to about two and one-half inches. The wall section 14 is provided with a pair of apertures or holes 34 (FIG. 4) in which suitable hot and cold water valves are mounted. The box 10 is constructed to accommodate any suitable valves such as those commonly referred to as boiler drain valves or a single actuator double valve 35 such as that illustrated. The illustrated valve 35 is commonly referred to as a single lever washing machine outlet valve and is more fully described in detail in U.S. Pat. No. 3,234,958 incorporated herein by reference. The lever 35*a* may be readily grasped inside the compact box to simultaneously turn both the hot and cold water 0N or OFF.

Figure 4:
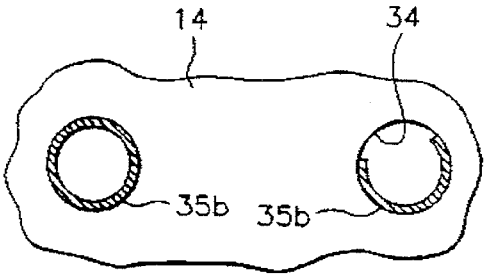
FIG. 4 is a partial vertical sectional view taken along line 4—4 of FIG. 2 with portions broken out showing details of the valve mounting holes.

The valve 35 is mounted as illustrated so that the outlets for connection of the hot and cold water supply hoses (not shown) to the washing machine extend downwardly. This way the washing machine water supply hoses may extend down along the front of the wall in which the outlet box is mounted in a manner that avoids kinking of the hoses. Similarly, the inlet shanks 35*b* of the valve body project outward behind the upper back wall section 14 as shown in FIG. 2. The back wall 14 is provided with the pair of spaced apart holes 34 as shown in FIG. 4 to permit the threaded inlet shanks 35*b* of the valve 35 to be mounted in the illustrated manner. Retaining nuts 36 (FIG. 2) screw over the threaded inlet shanks 35*b* to tightly secure the valve 35 to the wall 14. A portion of the right valve inlet shank 35*b* has been omitted in FIG. 4 to show the edge of one aperture 34.

This arrangement of the valve inlet holes 34 provides for convenient mounting or connection to water supply lines disposed in the building wall. The shallow washing machine outlet box constructed as illustrated provides a compact and convenient arrangement for easy mounting in building wall structure while accommodating the presence of water lines and the like that may be disposed in the wall structure directly behind the box. Since the valve shanks 35*b* extend horizontally, and because there is room in the wall behind the outlet box 10, the water supply lines can be connected from any direction, i.e., extending vertically from above or below, or horizontally from the left or the right. Conventional washing machine outlet boxes orient the valve shanks vertically and have no space in the wall behind them. Therefore the plumber has to route supply lines around and to the valve shanks with extra pipe elbows and pipe sections. This requires more soldering or adhesion welding and presents the possibility of more leaks.

The peripheral wall 20 is formed of the peripheral forward edge 22 in a rounded curved configuration folding or extending back so that the mounting flanges 24, 26 and 28 are spaced back of the forward edge 22 as shown in FIGS. 2 and 3. This positions the mounting flanges behind suitable wall board. This enables the mounting of the box 10 with wall board panel 38 extending to a position flush with the peripheral forward edge 22.

The lower bottom wall section 16 is formed with an outlet aperture 40 (FIG. 1) accommodating a drain line outlet. The drain line outlet is provided with a suitable mount such as with a tubular sleeve 42 (FIG. 2) of ABS or PVC that surrounds a sheet metal tube 44. The tube 44 is clamped at the opposite ends such as by crimping to form flanges 46 and 48 over the ends of the sleeve 42 and within the peripheral edge of aperture 40. This provides an outlet coupling to which an outlet or drain line pipe of PVC or ABS may be adhesively bonded in the usual manner. Typically a forty-five degree elbow will be solvent welded to the sleeve 42 and to a drain pipe in the wall.

As best seen in FIG. 2, the lower bottom wall 16 section preferably slopes at an angle of about forty-five degrees downward and forwardly to the bottom forward edge of the box 10. The intermediate wall section 18 preferably slopes downward and backward from the lower edge of the upper back wall 14 section to its intersection with the upper edge of the upper edge of wall section 16 at an angle of about forty-five degrees. This construction provides a shallow washing machine outlet box capable of fully accommodating water supply valves for connection to a washing machine and an outlet drain line within minimum space.

The outlet box 10 is provided with a peripheral escutcheon or cover plate 50 shown in part in FIGS. 1, 2 and 3 which is also preferably formed of sheet metal by stamping or drawing like the main box 10. This peripheral cover plate 50 covers the edges of wall board panel 38 and the like to form a finished installation. As shown in FIG. 3, the cover plate 50 is formed with downturned inner and outer edges to provide a smooth finished structure. The cover plate 50 is preferably provided with mounting holes for insertion of sheet metal screws 52 as shown in FIG. 3 for securing to the outlet box 10. Preferably each screw 52 mates with an opening or bore 54 in the forward edge 22 of the box 10. This provides a secure attachment of the cover plate 50 to the outlet box 10 and the surrounding structure.

Figure 5:
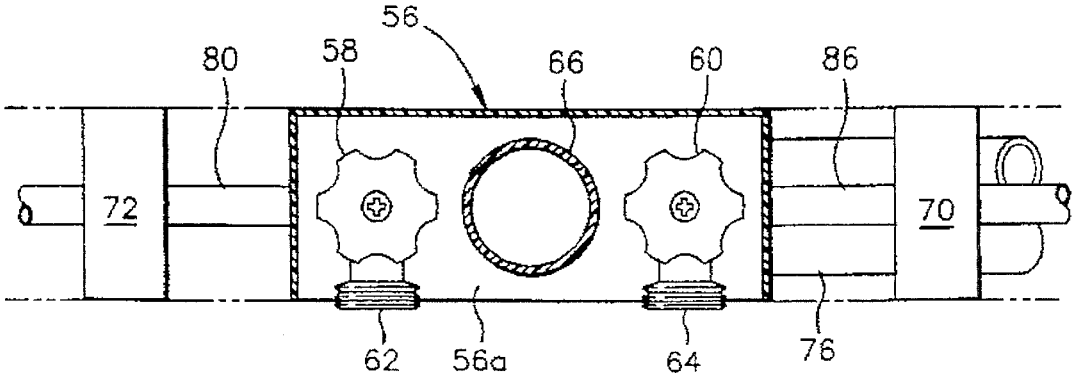
FIG. 5 (PRIOR ART)
FIG. 5 is a diagrammatic part horizontal sectional, part elevational view illustrating the installation of a conventional washing machine outlet box in accordance with the teachings of the prior art.
Figure 7:
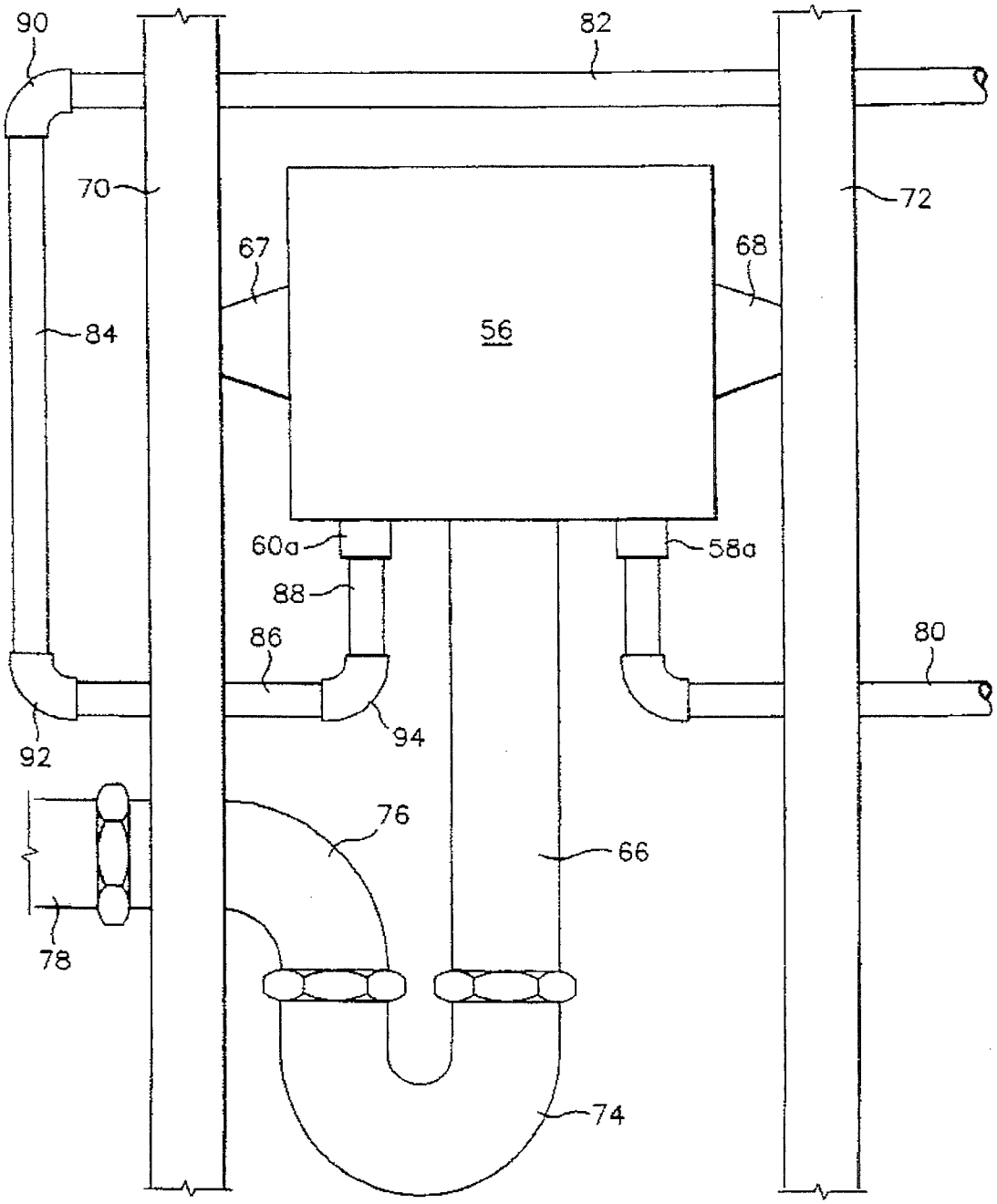
FIG. 7 (PRIOR ART)
FIG. 7 is a diagrammatic rear elevational view of the installation of FIG. 5.

Referring to FIGS. 5 and 7, a conventional washing machine outlet box 56 includes a pair of vertically oriented boiler drain valves 58 and 60 having horizontally extending threaded male outlets 62 and 64. A DWV drain pipe 66 extends vertically from the horizontal bottom wall 56a of the washing machine outlet box 56. Flanges or ears 67 and 68 extend from opposite sides of the washing machine outlet box 56 and are nailed to adjacent studs 70 and 72. The lower end of the drain pipe 66 is connected to a U-shaped trap 74 which in turn is connected to a ninety degree elbow 76 to a trap arm 78. A portion of the elbow 76 extends through a hole bored in the stud 70. A hot water supply line 80 is connected to the shank 58*a* of the hot water boiler drain valve 58. The hot water supply line 80 extends through a hole in the stud 72. However, because the outer diameter of the drain pipe 66 is substantial, there is insufficient room to bring the cold water supply line 82 across the drain pipe 66 to connect to the shank 60*a* to the cold water boiler drain valve 60. Instead, the cold water supply line 82 must extend to through both studs 70 and 72 above the washing machine outlet box 56. Segments of pipe 84, 86 and 88 are then soldered to the cold water supply line via elbows 90, 92 and 04 so that it can pass through the stud 70 again before being connected to the shank 60*a* of the cold water boiler drain valve 60. Clearly, the prior art installation illustrated in FIG. 7 requires a significant amount of additional plumbing, and more particularly, the cutting, fitting, and soldering of a significant number of Copper pipe segments 84, 86 and 88 as well as the Copper ninety degree elbows 90, 92 and 94.

Figure 6:
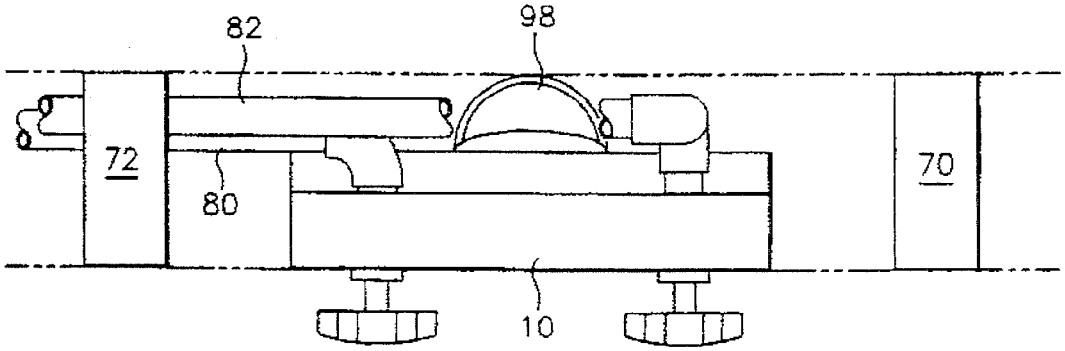
FIG. 6 is a diagrammatic top elevational view illustrating the installation of a compact washing machine outlet box in accordance with the present invention.
Figure 8:
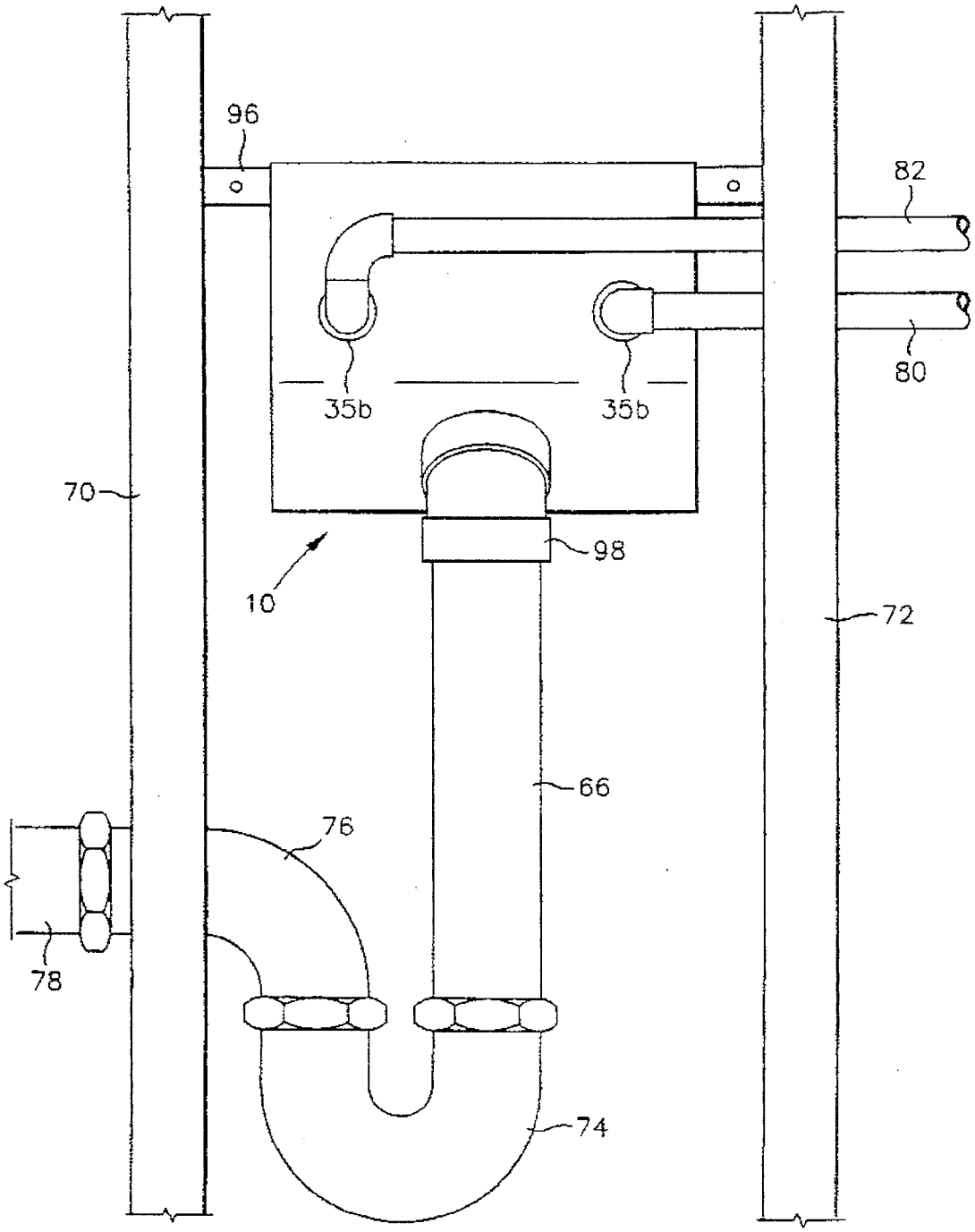
FIG. 8 is a diagrammatic rear elevational view of the installation of FIG. 6.

FIGS. 6 and 8 illustrate the installation of the compact washing machine outlet box 10 of the present invention. The outlet box 10 is secured midway between the vertical studs 70 and 72 with a segment of HYCO strap 96 which is nailed to the studs. The hot and cold water supply lines 80 and 82, extend parallel through holes in the studs 72 and are connected to the valve shanks 35*b* from the same side. A forty-five degree DWV elbow 98 is connected over the end of the angled sleeve 42 (not visible in FIGS. 6 and 8). The lower end of the elbow 98 is connected to the upper end of the drain pipe 66. It can be seen that the installation of the compact washing machine outlet box 10 of the present invention is much shallower. There is room to bring both water supply lines horizontally to the outlet box and connect them to the valve shanks 35*b* from the same side, because of the horizontal orientation of these valve shanks.

While I have illustrated and described my invention by way of a specific embodiment, it is to be understood that numerous changes and modifications may be made in the illustrated embodiment without departing from the spirit and scope of the invention as defined in the appended claims.

I claim:

1. A forwardly opening low profile washing machine outlet box, comprising:

a back wall having an upper vertical section and a lower downwardly extending forwardly sloping section;

a forwardly extending peripheral wall integral with and extending forwardly from a peripheral edge of said back wall;

first and second apertures in said upper section for mounting first and second valve shanks for connection to first and second water supply lines; and an enlarged aperture in said lower wall section for connection to a drain line and for receiving a washing machine drain hose.

2. A washing machine outlet box according to claim 1 wherein said lower wall section slopes at an angle of about forty-five degrees.

3. A washing machine outlet box according to claim 1 wherein a lower portion of said back wall includes an intermediate wall section that slopes downward and backward from a lower edge of said upper wall section in order to intersect and accommodate said forwardly sloping lower section.

4. A washing machine outlet box according to claim 3 wherein said lower wall section slopes at an angle of about forty-five degrees.

5. A washing machine outlet box according to claim 4 wherein said box is formed as a unitary sheet metal stamping.

6. A washing machine outlet box according to claim 1 wherein said box is molded as a single unitary piece of plastic.

7. A washing machine outlet box according to claim 1 wherein said peripheral wall has outwardly extending mounting flanges formed on at least two sides thereof.

8. A washing machine outlet box according to claim 7 wherein said mounting flanges are spaced from a forward edge of said peripheral wall for accommodating a layer of wall board panel.

9. A washing machine outlet box according to claim 8 wherein said back wall includes an intermediate wall section that slopes downward and backward from a lower edge of said upper vertical wall section in order to intersect and accommodate said forwardly sloping lower section.

10. A washing machine outlet box according to claim 1 and further comprising a cover plate attachable to the peripheral wall for overlapping a surrounding layer of wall board panel.

11. A front opening low profile washing machine outlet box, comprising:

a back wall having an upper vertical section, an intermediate downwardly extending backwardly sloping section and a lower downwardly extending forwardly sloping section;

a forwardly extending peripheral wall integral with and extending forwardly from a peripheral edge of said back wall:

first and second apertures in said upper back wall section for mounting first and second valve shanks for receiving first and second water supply lines; and an enlarged aperture in said lower back wall section for receiving a drain line connection and for receiving a washing machine drain hose.

12. A washing machine outlet box according to claim 11 wherein said lower back wall section slopes at an angle of about forty-five degrees.

13. A washing machine outlet box according to claim 12 wherein said intermediate back wall section slopes downward and backward at an angle of about forty-five degrees from a lower edge of said upper back wall section in order to connect and accommodate said forwardly sloping lower back wall section.

14. A washing machine outlet box according to claim 13 wherein said peripheral wall has a depth of about one inch at said upper vertical section and has outwardly extending mounting flanges on at least two sides thereof.

15. A washing machine outlet box according to claim 14 wherein said mounting flanges are spaced from a forward edge of said peripheral wall for accommodating a layer of wall board panel.

16. A washing machine outlet box according to claim 11 wherein said box is molded as a unitary piece of a plastic.

17. A front opening narrow profile washing machine outlet box formed as a unitary sheet metal structure, comprising:

a back wall having an upper vertical section, an intermediate downwardly extending backwardly sloping section and a lower downwardly extending forwardly sloping wall section, said lower section sloping at an angle of about forty-five degrees;

a forwardly extending peripheral wall integral with and extending forwardly from a peripheral edge of said back wall and formed with a rounded forwardmost edge;

first and second apertures in said upper section for mounting first and second valve shanks for receiving first and second washing machine water supply lines; and an enlarged aperture in said lower wall section for receiving a drain line connection and for receiving a washing machine drain hose.

18. A washing machine outlet box according to claim 17 and further comprising a single actuation double valve having a pair of shanks mounted in said first and second apertures.

19. A washing machine outlet box according to claim 17 and further comprising a plastic sleeve connected to the enlarged aperture in said lower wall section for adhesive bonding to a drain pipe.

* * * * *